US005135179A

United States Patent [19]

Morano

[11] Patent Number: 5,135,179

[45] Date of Patent: Aug. 4, 1992

[54] PAPER TOWEL DISPENSER WITH BRAKE

[75] Inventor: Michel Morano, Montreal, Canada

[73] Assignee: Wyant & Company Limited, Lachine, Canada

[21] Appl. No.: 651,184

[22] Filed: Feb. 6, 1991

[30] Foreign Application Priority Data

Aug. 10, 1990 [GB] United Kingdom ..... 9017620

[51] Int. Cl.[5] ..... B65H 19/00

[52] U.S. Cl. ..... 242/55.54; 242/68.3; 242/75.4

[58] Field of Search ..... 242/55.53, 68.3, 68.4, 242/75.4, 99, 55.54

[56] References Cited

U.S. PATENT DOCUMENTS

| | | | |
|---|---|---|---|
| 923,559 | 6/1909 | Moser | 242/99 |
| 1,986,500 | 1/1935 | Charbonneau | 242/55.54 |
| 2,503,051 | 4/1950 | Jeckert et al. | 242/55.54 |
| 2,570,491 | 10/1951 | Scardina | 242/55.54 |
| 3,018,977 | 1/1962 | Sallquisk | 242/68.4 |
| 4,002,238 | 1/1977 | Cameron et al. | 242/55.53 |
| 4,248,391 | 2/1981 | Ness | 242/55.54 |
| 4,345,851 | 8/1982 | Soussloff | 242/72.1 X |
| 4,487,376 | 12/1984 | Compton | 242/55.54 |
| 4,522,348 | 6/1985 | Strout et al. | 242/75.4 X |
| 4,664,327 | 5/1987 | Clymer | 242/68.3 |
| 4,722,493 | 2/1988 | Parry et al. | 242/99 X |
| 4,738,385 | 4/1988 | Bell | 242/55.54 X |

*Primary Examiner*—Daniel P. Stodola
*Assistant Examiner*—Tony A. Gayoso
*Attorney, Agent, or Firm*—Larson and Taylor

[57] ABSTRACT

A dispenser for dispensing a paper sheet from a paper roll having a core. The dispenser can have a spindle made of two separate sleeves. The sleeves are inserted in opposite ends of the core and frictionally retained therein. A support is rotatably mounted in one sleeve to support the roll. A brake member is rotatably mounted in the other sleeve and selectively cooperates therewith to brake rotation of the roll on the support.

27 Claims, 3 Drawing Sheets

PAPER TOWEL DISPENSER WITH BRAKE

BACKGROUND OF THE INVENTION

1. Field of the Invention

This invention is directed toward a dispenser for dispensing paper off a roll.

The invention is also directed toward brake means for use in a dispenser for dispensing paper off a roll.

2. Description of the Prior Art

Dispensers for dispensing paper towelling off a roll are known. The dispensers normally comprise a support or stand with a spindle extending axially from the stand. In known dispensers the roll normally is rotatably mounted on the spindle via a core in the roll. The paper towelling is dispensed by pulling it off the roll. The roll rotates on the spindle as the paper is pulled off. Operation of a brake associated with the dispenser will stop rotation of the roll and the pulled-off length of paper is then torn off the roll.

The spindle of the dispenser is made to fit one standard width of paper roll. If a different width of paper roll is desired to be used, then either a different length spindle must be substituted for the existing spindle, or a different dispenser must be used. Keeping an assortment of different length spindles, or different dispensers, on hand to accommodate different width rolls is expensive.

The brakes which are available at the present time operate by squeezing the ends of the roll of the paper towelling thus braking the rotating roll by friction. The braking action however takes time before the roll is completely stopped. The time involved in frictional braking can result in excess paper being dispensed off the roll before its rotation is stopped. In addition the braking action, involving pressing against the ends of the roll does not work when little paper is left on the roll and excess pressure on the roll can destroy the integrity of the roll which can result in a waste of paper.

SUMMARY OF THE INVENTION

It is one purpose of the present invention to provide an improved paper dispenser for paper rolls that can be used on different widths of roll, using the same spindle means. It is another purpose of the present invention to provide an improved brake for a paper dispenser. It is a further purpose of the present invention to provide an improved dispenser that can be used on different widths of roll, using the same spindle means, and with an improved brake.

In accordance with one embodiment of the present invention, there is provided a spindle means for a paper roll dispenser that consists of two sleeves, one insertable into each end of a paper roll core. The sleeves are sized to fit snugly into the core so that the core is frictionally retained on the sleeves. The axle of a support stand is rotatably inserted into one of the sleeves to support the roll. Brake means can be mounted in the other sleeve. The two-sleeve spindle means permits it to be used with paper rolls of various width since the sleeves are inserted into opposite ends of the core and need not be joined to be operational.

The brake of the present invention has means for positively locking with the spindle means when the brake is applied so as to immediately halt rotation of the spindle means and the paper roll mounted on it. Cooperating, interlocking brake elements are provided on both the spindle means and a brake member. The brake member is normally spaced from the brake elements on the spindle means. When braking is needed, the brake member can be moved against resilient means to have the cooperating brake elements interlock to instantaneously brake the paper roll.

The invention is particularly directed toward a dispenser for use in dispensing a paper sheet from a paper roll having a core. The dispenser has a spindle means comprising two separate sleeves. One sleeve is sized so it can be snugly inserted into one end of the core, so as to be normally non-rotatable relative to the core and the other sleeve is sized so it can be snugly inserted into the other end of the core so as to be normally non-rotatable relative to the core. A support for the paper roll is rotatably mounted within one sleeve and a brake member is rotatably mounted within the other sleeve.

The invention is also directed toward a dispenser for use in dispensing a paper sheet from a paper roll having a core, the dispenser having spindle means adapted to be snugly mounted within the core of the paper roll. A brake member is adapted to be rotatably and axially mounted within the spindle means. First brake elements are provided on the brake member and second brake elements are provided on the spindle means. The first and second brake elements are normally spaced apart. Axial movement of the brake member relative to the spindle means in one direction will interlock the first and second brake elements immediately stopping rotation of the paper roll. Resilient means can be provided to separate the brake elements releasing the brake.

DESCRIPTION OF THE PREFERRED EMBODIMENTS

Figure 1:
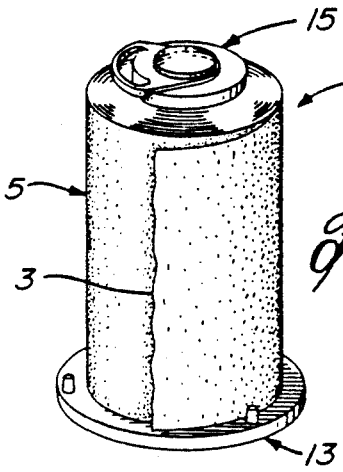
FIG. 1 is a perspective view of an operational dispenser.
Figure 2:
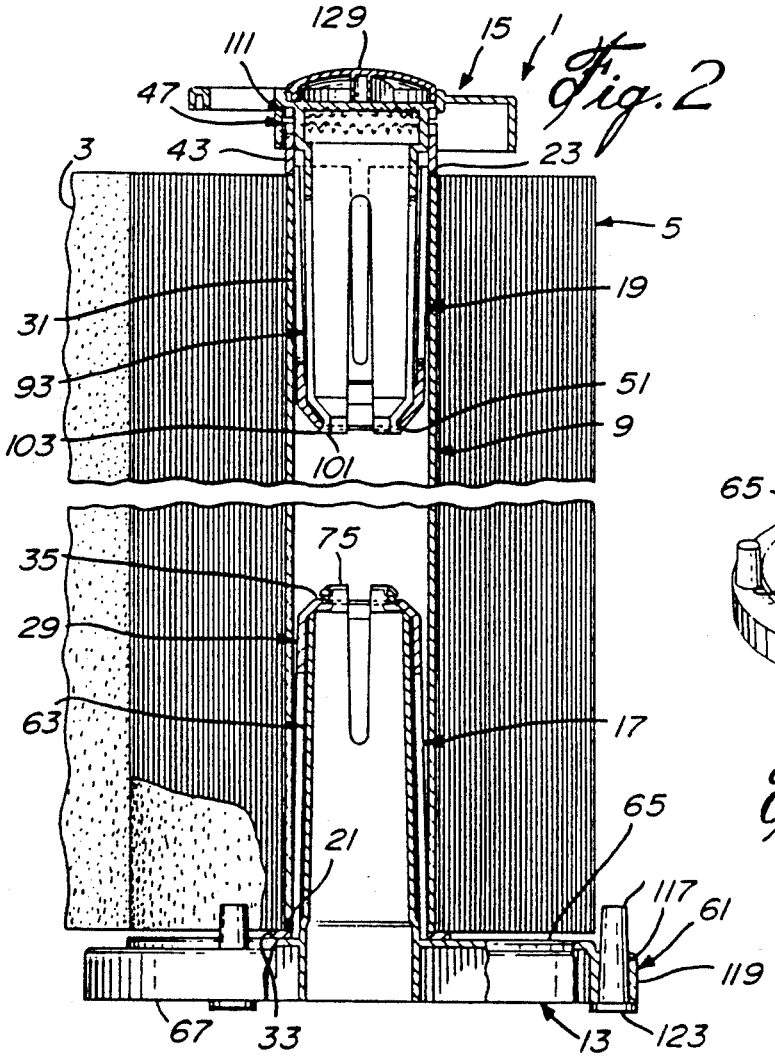
FIG. 2 is a cross-section view of the dispenser.

The dispenser 1 as shown in FIGS. 1 and 2 is used to dispense a sheet 3 of paper, such as towelling, from a roll 5. The roll 5 is formed by winding the sheet 3 in a coil on a core 9. The core 9 is preferably made of cardboard.

Figure 3:
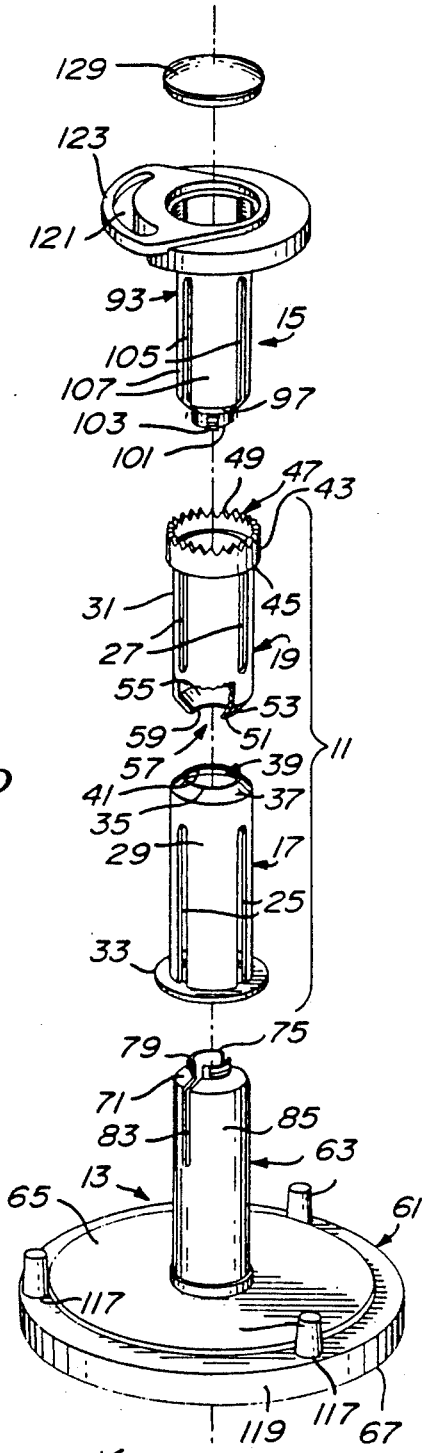
FIG. 3 is an exploded, perspective view of the dispenser without the paper roll.

The dispenser 1 has a spindle means 11, a support 13, and a brake member 15. In the preferred embodiment of the invention, the spindle means 11, as shown in FIGS. 2 and 3, consists of two cylindrical sleeves 17, 19. Both sleeves 17, 19 are sized to fit snugly, normally non-rotatably, within the core 9 of the paper roll 5. The first sleeve 17 is adapted to be inserted into the core 9 from one end 21 of the core, and second sleeve 19 is adapted to be inserted into the core 9 from the other end 23 of the core. Both sleeves 17, 19 can have longitudinal slots 25, 27 formed in their bodies 29, 31 and spaced apart about their periphery. The slots 25, 27 make sleeves 17, 19 slightly more flexible, allowing the sleeves 17, 19 to more easily fit into cores having small variations or tolerances in their inner diameter.

Figure 4:
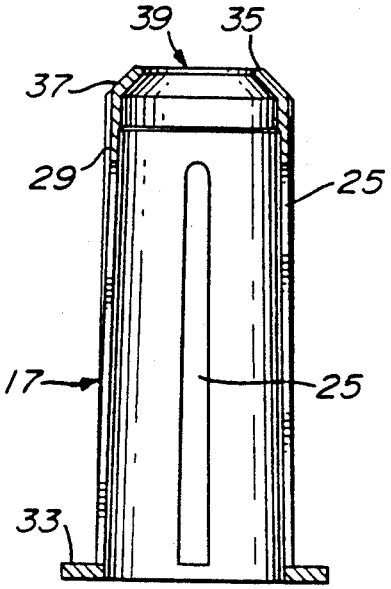
FIG. 4 is a cross-section view of one of the spindle sleeves.
Figure 5:
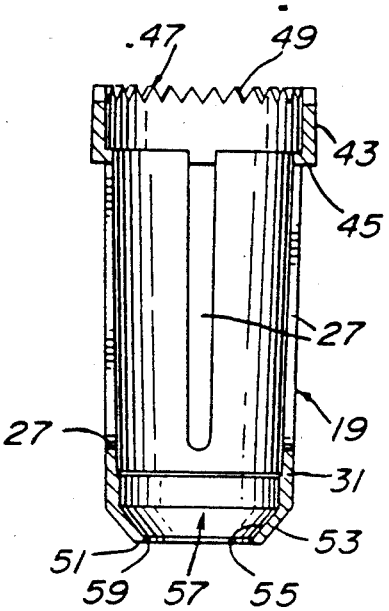
FIG. 5 is a cross-section view of the other spindle sleeve.

The first sleeve 17 as shown in FIGS. 3 and 4 has a narrow lateral flange 33 at its outer end that abuts the end 21 of the core 9 when the sleeve is inserted into the core. The body 29 of the first sleeve 17, adjacent its inner end 35, is angled inwardly to present a conical entry surface 37 making it easy to insert the sleeve into a core. The first sleeve 17 has a central circular opening 39 in its inner end 35, defined by circular edge 41. The second sleeve 19 as shown in FIGS. 3 and 5 has a short, cylindrical extension 43 at its outer end that is slightly larger in diameter than the body 31 of the sleeve. A stop flange 45 is formed at the junction of the extension 43 and the sleeve body 31 which stop flange abuts against the end 23 of the core 9 when the sleeve 19 is inserted into the core. The outer end of the extension 43 has braking means 47 thereon. The braking means 47 can be in the form of serrated teeth 49 formed in the outer edge of the extension 43, the teeth pointing outwardly in a direction parallel to the longitudinal axis of the sleeve 19. The second sleeve 19 is angled inwardly adjacent its inner end 51 to provide an outer conical entry surface 53 and an inner camming surface 55. A central, circular opening 57 is formed in the inner end 51, defined by circular edge 59.

Figure 6:
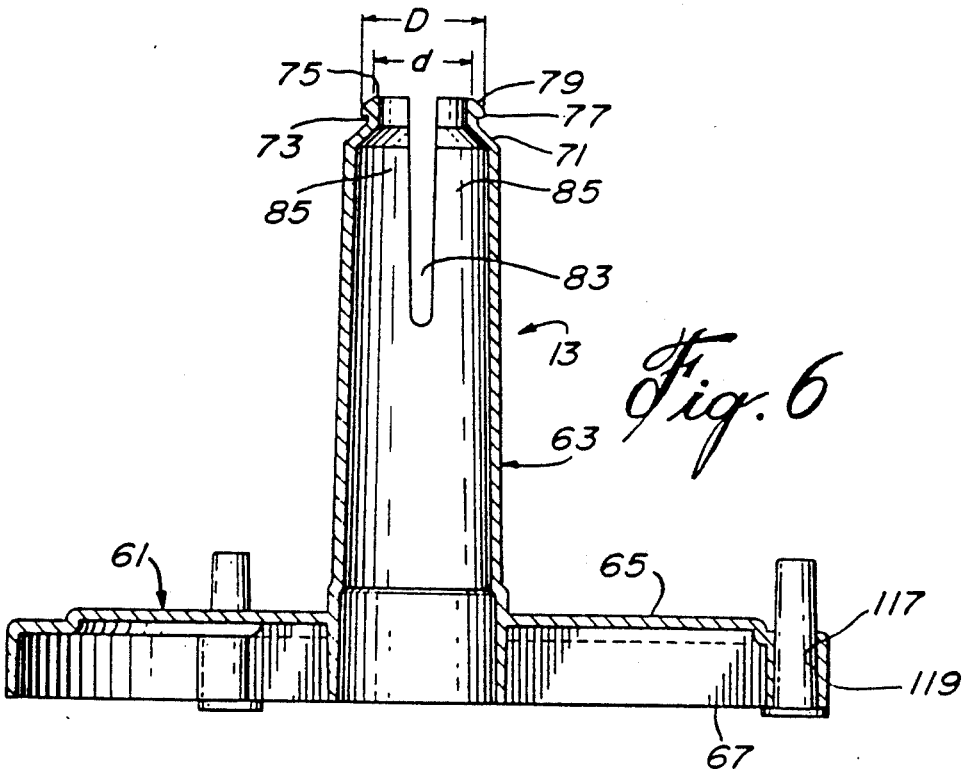
FIG. 6 is a cross-section view of the dispenser support.

The support 13 for the dispenser 1, as shown in FIGS. 3 and 6, comprises a relatively large cylindrical base 61 having a tubular axle 63 projecting axially from one side 65 of the base 61. The base 61 is adapted to sit on its opposite side 67 on a flat surface to support the roll of paper in an upright position. The axle 63 of the support 13 is sized to closely fit within the first sleeve 17, while being rotatable therein. The outer portion of the axle 63 is angled inwardly as shown at 71. A short tubular section 73, smaller in diameter than the main body of the axle 63, projects axially from the inwardly angled portion 71 and terminates in the outer end 75 of the axle 63. The tubular section 73 has an outwardly directed rib 77 adjacent its outer end 75. The rib 77 has a conical entry surface 79. The smaller, outer diameter "d" of the entry surface 79 is slightly smaller than the diameter of the opening 39 in the inner end 35 of the first sleeve 17 while the larger inner diameter "D" of the entry surface 79 is larger than the opening 39. The diameter of the tubular section 73 is slightly smaller than the diameter of opening 39. Two slots 83 extend longitudinally inwardly from the outer end 75 of the axle, past the angled portion 71, into the main body of the axle 63. The slots 83 are equally spaced apart and form somewhat resilient fingers 85 in the outer portion of the axle 63. The resilient fingers 85 form means for use in rotatably connecting the first sleeve 17 to the support 13 as will be described.

Figure 7:
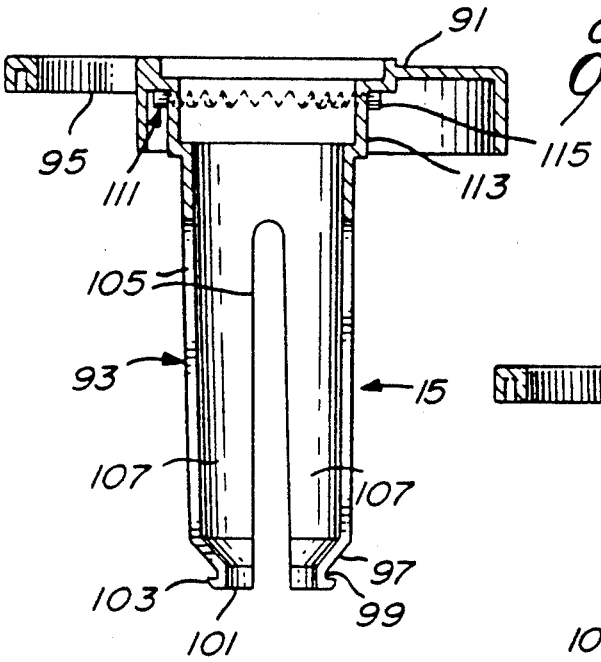
FIG. 7 is a cross-section view of the dispenser brake member.

The brake member 15, as shown in FIGS. 3 and 7, has a generally cylindrical head 91 with an axle 93 projecting axially from one side 95 of the head 91. The axle 93 of the brake member 15 is sized to closely fit within the second sleeve 19 while being rotatable therein. The outer portion of the axle 93 is angled inwardly as shown at 97. A short, tubular section 99 projects axially from the angled portion 97 and terminates in the outer end 101 of the axle 93. The tubular section 99 is slightly smaller in diameter than the opening 57 in the second sleeve 19. A rim 103 extends outwardly from the tubular section 99 adjacent the outer end 101. The rim 103 is larger in diameter than the opening 57 in the second sleeve 19. Four slots 105 extend longitudinally inwardly from the outer end 101 of the axle 93 well into the main body of the axle. The slots 105 are equally spaced-apart and form four resilient fingers 107 in the axle 93. The resilient fingers 107 form means for detachably connecting the second sleeve 19 to the brake member, and also provide spring means for use in the brake as will be described.

Brake means 111 are provided on the brake member 15 that cooperate with the brake means 47 on the second sleeve 19. The brake means 111 comprise a collar 113 formed about the axle 93 adjacent the one side 95 of the cylindrical head 91. Serrated teeth 115 are formed in the collar 113 pointing in a direction parallel to the longitudinal axis of the axle 93 and away from the head 91. The serrated teeth 115 are formed to interlock with the serrated teeth 49 on the second sleeve 19.

The base 61 of the mounting 13 can be provided with three equally spaced-apart openings 117 adjacent its peripheral edge 119 as shown in FIGS. 2 and 3. The openings 117 can be used to permanently mount the mounting 13 and thus the dispenser, with screws (not shown) on a horizontal or vertical surface. The openings 117 can also be used to receive short posts 125. The posts have a narrow base 127 and taper very slightly upwardly from the base so that each post can be wedged tightly in an opening 117. When tightly wedged in the opening the base 127 of the posts 125 extend just below the base 61 of the mounting 13 to provide foot pads for the mounting 13. The base 127 of the posts can be coated with non-slip material, or the posts can be made from non-slip material to prevent the dispenser from sliding. Each post 125 extends a short distance above the base 61 when wedged in the opening and also extends up the side of a full roll of paper when the dispenser is assembled. The posts prevent the paper from unwinding.

To assemble the dispenser 1, the first sleeve 17 is mounted on the support 13 by sliding the sleeve 17 over the axle 63 until the rib 77 passes through the opening 39 in the sleeve. The entry surface 79 on the rib 77 cams the resilient fingers 85 inwardly as the surface passes the edge 41 of the opening 39. Once the rib 77 passes the edge 41, the fingers 85 spring back and the rib 77 overlies the inner end 35 of the first sleeve 17 connecting the support 13 to the sleeve. The sleeve 17, with its flange 33 resting on the base 61 of the support 13, is rotatable on the support.

Figure 8:
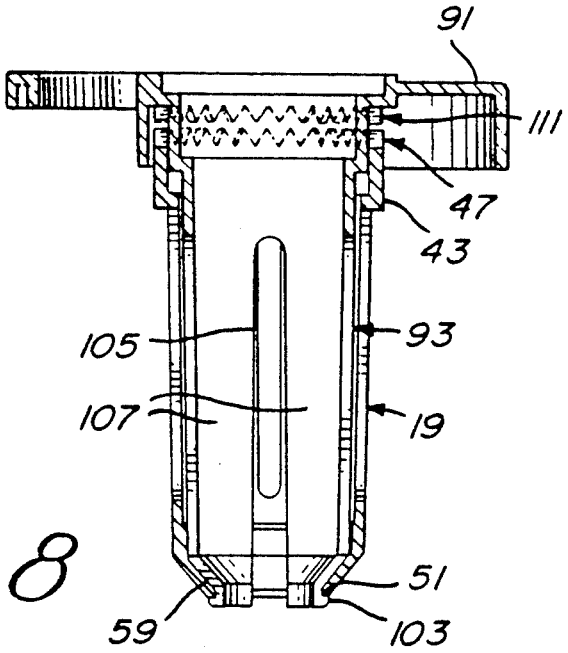
FIG. 8 is a detail view of the brake in a released position.

The brake member 15 is connected to the second sleeve 19 by inserting its axle 93 through the sleeve until the rim 103 passes through the opening 57 in the sleeve. In passing through the sleeve 19, the inner cam surface 55 on the sleeve adjacent its inner end 51 cams the resilient fingers 107 inwardly until the rim 103 passes the edge 59. The fingers 107 then spring back and the brake member 15 is held in place, connected to the sleeve 19, by the edge 59 of the sleeve resting adjacent the reduced tubular portion 99 of the axle 93 between the rim 103 and the angled, camming surface 97. The brake member 15 is rotatable in the sleeve 19 and in the position described, the brake means 111 on the axle 93 are longitudinally separated from the brake means 47 on the sleeve 19 as shown in FIG. 8.

The dispenser 1 is now readied for use by inserting the sleeve 17 which is mounted on the support 13 into one end of the core 9 of the paper roll 5 and inserting the sleeve 19 which is mounted on the brake member 15 into the other end of the core.

The assembled dispenser 1, carrying the roll 5, can be placed on a table or other support resting on base 61. It can be permanently fastened to the support with screws through the holes 117 in base 61 if desired. A length of paper sheet can be pulled off the roll with one hand while the other hand holds the head 91 of the brake member 15 to stabilize the dispenser 1. The roll 5 rotates freely on the axles 63, 93 via the sleeves 17, 19 which are frictionally held in the core, as the paper is pulled off. When the desired amount of paper has been pulled off, the head 91 of the brake member 15 is pushed toward the support 13. The head 91 is prevented from rotating while being pushed and when pushed, the braking teeth 115 on the axle 93 interlock with the braking teeth 49 on the sleeve 19 to stop the sleeve, and thus the roll 5, from further rotation. The braking is instantaneous. The piece of paper can now be torn off the roll.

Figure 9:
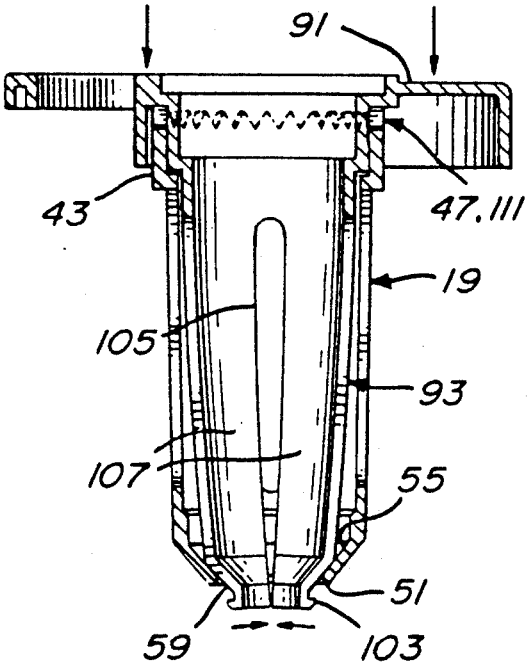
FIG. 9 is a view similar to FIG. 8 with the brake operational.

As the brake member 15 is being pushed toward the support 13, the cam surface 97 on the axle 93 rides against the edge 51 of the sleeve 19 camming the resilient fingers 107 inwardly as shown in FIG. 9. When the pushing pressure against the brake member 15 is released, after tearing off the sheet, the resilient fingers 107 spring back and, via cam surface 97, move the brake member 15 axially away from the support member 13 thereby separating the teeth 49, 115 and thus releasing the brake. The resilient fingers 107 act as a return spring, returning the brake member 15 to its released position. The roll 5 is again freely rotatable on the support 13.

The head of the brake member 15 can be pushed with the forearm or elbow of a person wishing to use the dispenser if the hands are too dirty to operate it. The base of the mounting 13 can be adapted to be hung on a wall with the towel roll horizontal. The head 91 of the brake member 15 can be provided with an opening 121 therein as shown in FIG. 3. The opening 121 forms an integral handle 123 in the head. The handle 123 allows the assembled dispenser to be easily carried about.

The top of brake member 15 can be closed off with a cap 129 which can be embossed or printed with a logo or Trade Mark for identification purposes.

I claim:

1. A dispenser for using in dispensing a paper sheet from a paper roll having a core with at least a bore at each end thereof, the dispenser having spindle means for mounting the paper roll core, said spindle means comprising first and second individual, separate sleeves having respective openings therein, said first sleeve sized so it can be snugly inserted into the bore at one end of the core so as to be normally non-rotatable relative to the core, said second sleeve having first braking elements and sized so it can be snugly inserted into the bore at the other end of the core so as to be normally non-rotatable relative to the core;

a support for the paper roll rotatably mounted in the opening of said first sleeve; and a brake member rotatably mounted in the opening of said second sleeve and having second braking elements which are resiliently engageable with said first braking elements for positively stopping the relative rotation between said brake member and said second sleeve.

2. A dispenser as claimed in claim 1, wherein the support for the paper roll is insertable into the first sleeve, the first sleeve being rotatable on the inserted support;

and wherein the brake member is insertable into the second sleeve, the second sleeve normally being freely rotatable with respect to the inserted brake member thereby allowing the paper roll, carrying the sleeves, to rotate on the support.

3. A dispenser as claimed in claim 2 wherein the brake member is axially movable in the second sleeve between a first non-braking position where the second sleeve can rotate with respect to the brake member, and a second braking position where the brake member prevents rotation of the second sleeve and thus rotation of the roll, the brake member and the second sleeve having cooperating, interengaging brake elements that are engaged when the brake member is in the second braking position.

4. A dispenser as claimed in claim 3 including resilient means normally biasing the brake elements on the brake member away from the brake elements on the second sleeve.

5. A dispenser as claimed in claim 4 including first cooperating retaining means on the support and the first sleeve for rotatably retaining the support in the first sleeve and second cooperating retaining means on the brake member and the second sleeve for rotatably retaining the brake member in the second sleeve.

6. A dispenser as claimed in claim 5 including handle means on the brake member for use in transporting the paper roll when the sleeves are in the core roll.

7. A dispenser as claimed in claim 6 wherein the support has a base and an axle projecting from the base, the axle insertable into the first sleeve.

8. A dispenser as claimed in claim 7 wherein the support axle has an inner end spaced from the base; the first sleeve has an inner end and an outer end, the outer end of the first sleeve adjacent the one end of the core when the sleeve is inserted into the core; the first cooperating retaining means located on the support axle adjacent its inner end and on the first sleeve adjacent its inner end.

9. A dispenser as claimed in claim 8 wherein the retaining means on the support axle comprises a necked-down portion adjacent its inner end, and the retaining means on the sleeve comprises an inturned portion adjacent its inner end which is adapted to sit in the necked-down portion of the support axle and thus rotatably retain the support in the first sleeve.

10. A dispenser as claimed in claim 9 wherein the support axle at its inner end is formed with longitudinal extending, resilient fingers allowing the inner end of the support axle to pass the inturned portion on the sleeve so that the inturned portion can rest in the necked-down portion on the axle.

11. A dispenser as claimed in claim 7 including spaced-apart mounting openings in the base adjacent the periphery of the base.

12. A dispenser as claimed in claim 11 including posts insertable into the mounting openings.

13. A dispenser as claimed in claim 2 including first cooperating retaining means on the support and the first sleeve for rotatably retaining the support in the first sleeve.

14. A dispenser as claimed in claim 2 including second cooperating retaining means on the brake member and the second sleeve for rotatably retaining the brake member in the second sleeve.

15. A dispenser as claimed in claim 14 wherein the brake member has a generally cylindrical head and an axle projecting from the head, the axle insertable into the second sleeve.

16. A dispenser as claimed in claim 15 wherein the brake axle has an inner end spaced from the head; the second sleeve has an inner end and an outer end, the outer end of the second sleeve adjacent the other end of the core when the sleeve is inserted into the core; the second cooperating retaining means located on the brake axle adjacent its inner end, and on the second sleeve adjacent its inner end.

17. A dispenser as claimed in claim 16 wherein the retaining means on the brake axle comprises a necked-down portion adjacent its inner end, and the retaining means on the second sleeve comprises an inturned portion adjacent its inner end which is adapted to sit in the necked-down portion of the axle and thus rotatably retain the brake member in the second sleeve.

18. A dispenser as claimed in claim 17 wherein the brake axle at its inner end is formed with longitudinal extending resilient fingers allowing the inner end of the brake axle to pass the inturned portion on the second sleeve so that the inturned portion can rest in the necked-down portion of the brake axle.

19. A dispense as claimed in claim 18 wherein the cooperating brake elements are on the outer end of the brake axle and the outer end of the sleeve and means are provided normally spacing the brake elements on the brake axle from the brake elements on the second sleeve.

20. A dispenser as claimed in claim 19 wherein the spacing means comprise a camming surface on the necked-down portion of the brake axle, the camming surface normally abutting the inturned portion on the second sleeve to space the brake elements apart.

21. A dispenser as claimed in claim 2 wherein the camming surface is partly movable past the inturned position when the brake member is pushed into the sleeve to have its brake elements engage the brake elements on the second sleeve, the camming surface causing the resilient fingers to move radially inwardly, the inwardly moved fingers returning to their original position when the brake member is released to disengage the brake elements.

22. A dispenser for use in dispensing a paper sheet from a paper roll having a core with a bore therein, the dispenser having:

an elongate spindle means for mounting the core of the paper roll, said spindle means insertable into the bore of the core and sized so that it frictionally engages the core to be normally non-rotatable relative to the core, said spindle means having an opening at each end thereof;

a support for the paper roll in the opening at only one end of the spindle means and freely rotatable with respect to the spindle means; and a brake member in only the opening at the other end of the spindle means, the spindle means normally, freely rotatable with respect to the inserted support and brake members thereby allowing the paper roll, carrying the spindle means, to rotate on the support, the brake member and the spindle means having cooperating, resiliently interengagable brake elements for positively stopping the relative rotation between said brake member and said spindle means when engaged.

23. A dispenser for use in dispensing a paper sheet from a paper roll having a core with a bore therein, the dispenser having:

spindle means for mounting the core of the paper roll, said spindle means insertable into the bore of the core and sized so that it frictionally engages the core to be normally non-rotatable relative to the core, said spindle means having an opening at each end thereof;

a support for the paper roll insertable into the opening at one end of said sleeve, said sleeve freely rotatable with respect to the support; and a brake member insertable into the opening at the other end of the spindle means, wherein the brake member is axially movable in the spindle means between a first non-braking position where the spindle means can rotate with respect to the brake member, and a second braking position where the brake member prevents rotation of the spindle means and thus prevents rotation of the roll, the brake member and the spindle means having cooperating, interengaging brake elements that are engaged when the brake member is in the second braking position.

24. A dispenser as claimed in claim 13 including resilient means normally biasing the brake elements on the brake member away from the brake elements on the spindle means.

25. A dispenser for use in dispensing a paper sheet from a paper roll having a core with a bore therein, the dispenser having:

elongate spindle means for mounting the paper roll core, said spindle means insertable into the bore of the core and sized so that it frictionally engages the core to be normally non-rotatable relative to the core of the paper roll and said spindle means having a bore at one end thereof;

a brake member insertable into said bore at said one end of the spindle means, the brake member axially movable in the spindle means between a first non-braking position where the spindle means can freely rotate with respect to the brake member, and a second braking position where the brake member prevents rotation of the spindle means and thus prevents rotation of the roll;

first brake elements on the brake member, second brake elements on the spindle means, the first and second brake elements normally spaced apart with the brake member in the first position and the first and second brake elements interlocking with each other with the brake member in the second position thereby preventing rotation of the paper roll.

26. A dispenser as claimed in claim 25 including means to normally space the first and second brake elements apart.

27. A dispenser as claimed in claim 26 wherein the spacing means are resilient.

* * * * *

UNITED STATES PATENT AND TRADEMARK OFFICE

CERTIFICATE OF CORRECTION

PATENT NO. : 5,135,179

DATED : Aug. 4, 1992

INVENTOR(S) : Michel MORAND

It is certified that error appears in the above—identified patent and that said Letters Patent is hereby corrected as shown below:

On the title page: Item [75]

The name of the inventor is:

Michel MORAND

Signed and Sealed this

Twenty-fourth Day of August, 1993

Bruce Lehman

*Attest:*

BRUCE LEHMAN

*Attesting Officer*

*Commissioner of Patents and Trademarks*